US005394050A

United States Patent [19]

Aoyama

[11] Patent Number: 5,394,050

[45] Date of Patent: Feb. 28, 1995

[54] ELECTRIC DISCHARGE LAMP APPARATUS FOR LIGHT SOURCE OF AUTOMOTIVE LIGHTING DEVICE

[75] Inventor: Tomonori Aoyama, Shizuoka, Japan

[73] Assignee: Koito Manufacturing Co., Ltd., Tokyo, Japan

[21] Appl. No.: 62,765

[22] Filed: May 18, 1993

[30] Foreign Application Priority Data

Jul. 8, 1992 [JP] Japan ..... 4-180688

[51] Int. Cl.[6] ..... H01J 61/40

[52] U.S. Cl. ..... 313/112; 313/635

[58] Field of Search ..... 313/112, 113, 635, 634, 313/25

[56] References Cited

U.S. PATENT DOCUMENTS

| | | | |
|---|---|---|---|
| 4,356,429 | 10/1982 | Tang | 313/503 |
| 4,482,841 | 11/1984 | Tiku et al. | 313/503 |
| 4,539,507 | 9/1985 | Van Slyke et al. | 313/504 |
| 4,595,599 | 6/1986 | Brown et al. | 427/5 |
| 4,720,432 | 1/1988 | VanSlyke et al. | 428/457 |
| 4,733,128 | 3/1988 | Tohda et al. | 313/503 |
| 4,769,292 | 9/1988 | Tang et al. | 428/690 |
| 4,839,553 | 6/1989 | Mellor | 313/111 |
| 4,839,852 | 6/1989 | Knutsen | 364/900 |
| 4,885,211 | 12/1989 | Tang | 428/457 |
| 5,104,740 | 4/1992 | Shinkai et al. | 428/457 |
| 5,124,618 | 6/1992 | Ohtaka et al. | 313/489 |
| 5,126,619 | 6/1992 | Wakimizu | 313/112 |
| 5,214,345 | 5/1993 | Saito | 313/112 |
| 5,220,235 | 6/1993 | Walkimizu | 313/25 |
| 5,250,872 | 10/1993 | Wakimizu | 313/25 |
| 5,306,572 | 4/1994 | Ohashi | 428/917 |

FOREIGN PATENT DOCUMENTS

| | | | |
|---|---|---|---|
| 0209345 | 1/1987 | European Pat. Off. | H01S 61/52 |
| 2438952 | 10/1979 | France | H05B 33/12 |
| 3743627 | 7/1989 | Germany | H01S 61/82 |
| 3904926 | 8/1989 | Germany | H01S 61/16 |
| 48-19194 | 6/1973 | Japan . | |
| 2196475 | 8/1990 | Japan | H05B 33/14 |
| 2207488 | 8/1990 | Japan | H05B 33/14 |
| 1553380 | 8/1976 | United Kingdom | H01S 61/40 |
| 2245417A | 1/1992 | United Kingdom | H01S 61/34 |

*Primary Examiner*—Edward L. Coles, Sr.
*Assistant Examiner*—Jerome Grant, II
*Attorney, Agent, or Firm*—Sughrue, Mion, Zinn, Macpeak & Seas

[57] ABSTRACT

In an electric discharge lamp apparatus for a car lighting instrument in which an arc tube forming a light source body and mounted on the front of an insulating base is surrounded by an ultraviolet-ray shielding globe constituted by a glass globe body whose surface is covered with a ZnO film, a waterproof SiC film is further formed on the ZnO film. The SiC film prevents the ZnO film from separating and peeling due to erosion caused by water droplets forming due to condensation or the like, and also prevents the ZnO film from becoming dull due to reaction with moisture.

6 Claims, 3 Drawing Sheets

ELECTRIC DISCHARGE LAMP APPARATUS FOR LIGHT SOURCE OF AUTOMOTIVE LIGHTING DEVICE

BACKGROUND OF THE INVENTION

The present invention relates to an electric discharge lamp apparatus used as a light source of an automotive lighting device such as a headlamp.

An electric discharge lamp has a high luminance, high efficiency and long life. However, the light emitted from such a lamp includes ultraviolet rays of wavelengths which are harmful to health and damaging to adjacent components. Therefore, as proposed in Japanese Patent Unexamined Publication No. Hei-2-253554, etc., and as shown in attached FIG. 5, a ZnO film, which cuts off ultraviolet rays in a predetermined wavelength range, may be formed on the surface of a bulb 4 surrounding an arc tube 2 forming a light source body so that ultraviolet rays in harmful wavelength ranges are eliminated from the light emitted from the arc tube 2.

However, these proposals have been limited to electric discharge lamps for indoor use, as opposed to an electric discharge lamp used as a light source of an automotive lighting instrument such as a headlamp, which must be able to withstand harsh environmental conditions. Specifically, there has been a problem that a lamp having a ZnO film formed on the surface of a glass globe thereof cannot withstand harsh operating conditions such as found in a desert, etc. That is, in an environment where water droplets condense and adhere to the surface of an ultraviolet-ray shielding globe, such as when the temperature, humidity or atmospheric pressure repeatedly changes, there is a problem that the ZnO film separates from the globe, whereupon the ultraviolet-ray shielding effect is reduced. There is another problem in that the transmission factor for visible light is reduced when moisture condenses on the globe because the ZnO film becomes dull when damp.

SUMMARY OF THE INVENTION

The foregoing problems have been taken into consideration in the present invention, and it is therefore an object of the present invention to provide an electric discharge lamp apparatus intended for use as a light source of an automotive lighting device in which the aforementioned problems have been eliminated.

In order to attain the foregoing and other objects, according to the present invention there is provided an electric discharge lamp apparatus for use as a light source of an automotive lighting device in which an arc tube forming a light source body is mounted on the front of an insulating base and is surrounded by an ultraviolet-ray shielding globe on the surface of which a ZnO film is formed, characterized in that a weatherproof SiC film is formed over the ZnO film.

The globe body may be composed of glass which cuts off ultraviolet rays in a wavelength range shorter than 320 nm, while the ZnO film cuts off ultraviolet rays in a range of 320 to 380 nm. Preferably, the Sic film is made thinner than the ZnO film.

Of the light emitted from the arc tube, ultraviolet rays of wavelengths shorter than 320 nm are cut when the emitted light passes through the globe body, while ultraviolet rays in the wavelength range of 320 to 380 nm are cut when the emitted light is transmitted through the ZnO film. Further, ultraviolet rays in the wavelength range of 320 to 380 nm are cut to some extent when the light is transmitted through the SiC film, although the cut ratio is smaller than for the case of the ZnO film.

The SiC film which covers the ZnO film is not eroded by water and does not react with water, thus preventing the ZnO film from directly contacting water droplets adhering to the ultraviolet-ray shielding globe. The danger of the ZnO film peeling off the globe due to contact with water is eliminated, as is dulling of the ZnO film due to reaction with water.

Since the SiC film has a refractive index smaller than that of the ZnO film and it is preferably thinner than the ZnO film, the reflection loss is very small so that the transmission factor of visible light is high.

DESCRIPTION OF THE PREFERRED EMBODIMENTS

Preferred embodiments of the present invention will be described with reference to the drawings.

Figure 1:
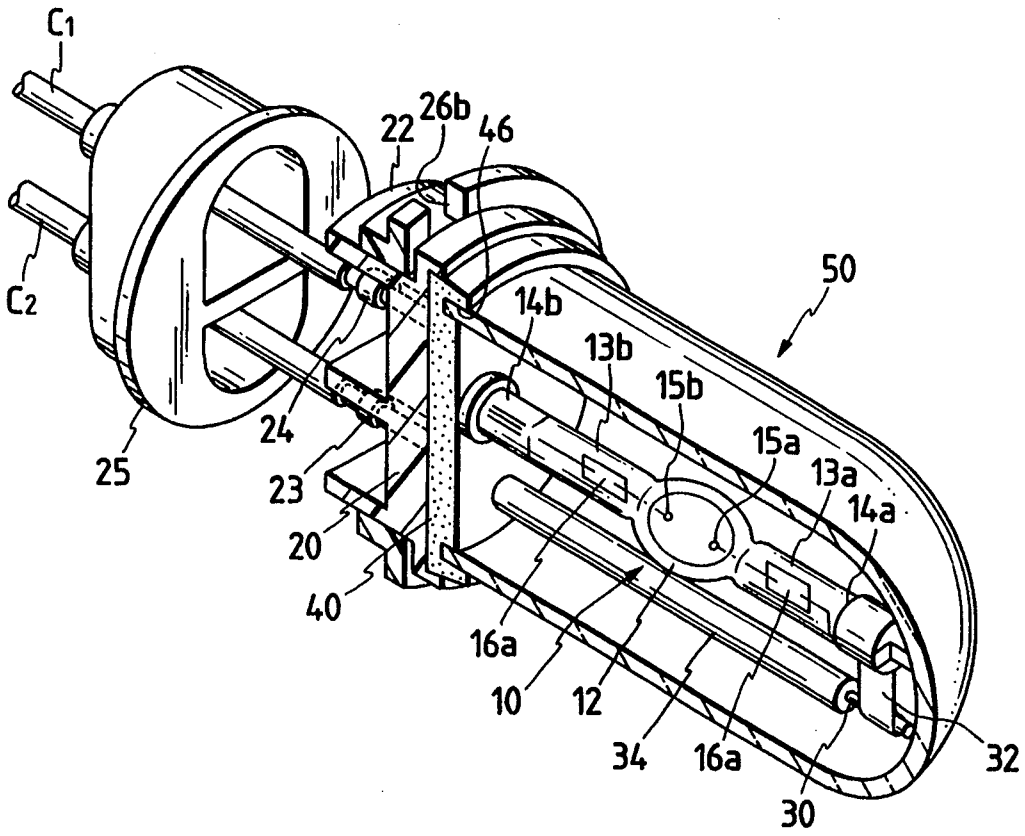
FIG. 1 is a partially broken perspective view of an electric discharge lamp used as a light source of an automotive headlamp, which is constructed according to a preferred embodiment of the present invention.
Figure 2:
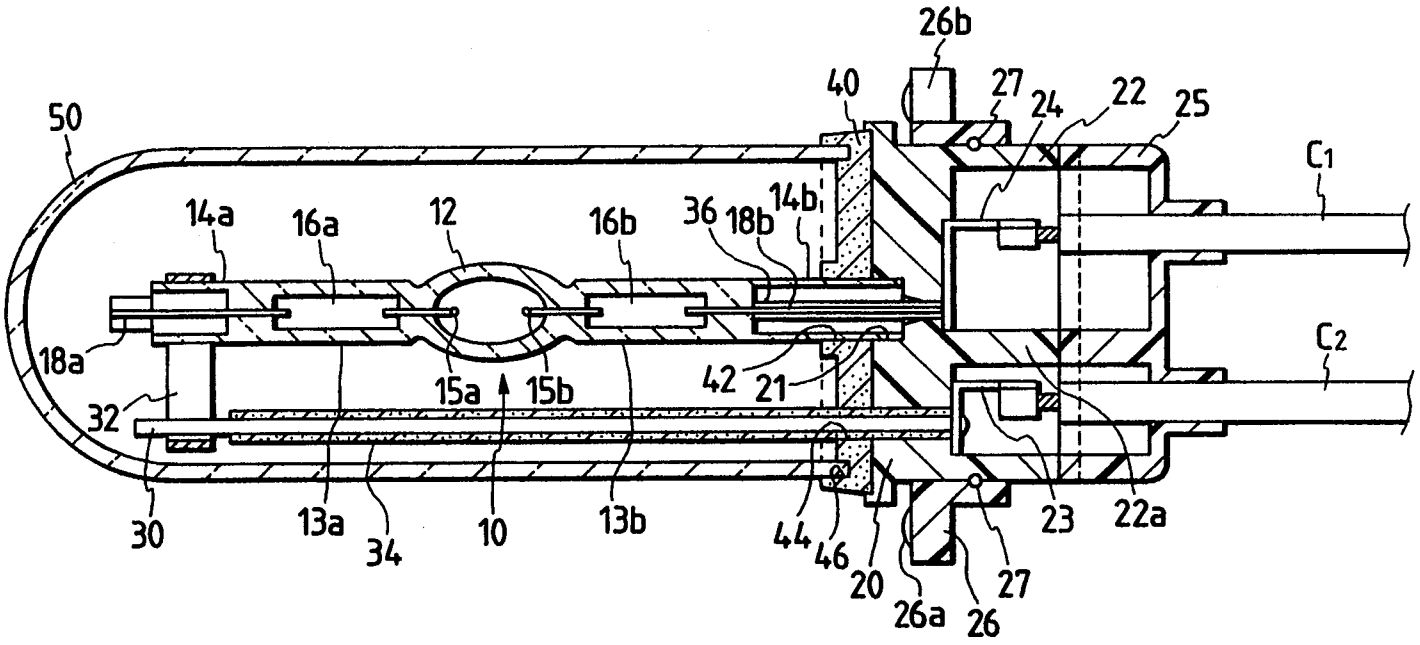
FIG. 2 is a longitudinal sectional view of the same electric discharge lamp.

FIGS. 1 and 2 show a preferred embodiment of the present invention, of which FIG. 1 is a partially broken perspective view illustrating an electric discharge lamp apparatus and FIG. 2 is a longitudinal sectional view of the same electric discharge lamp apparatus.

In these drawings, the electric discharge lamp apparatus is constituted mainly by an arc tube 10, which is an electric discharge lamp body, an insulating base 20, which is a lamp holder formed of synthetic resin, a metal lead support 30, which penetrates the base 20 so as to function as an electrical passageway and supports the front end portion of the arc tube 10, an engagement concave portion 21, which is formed on the front side of the base 20 so as to support the rear end portion of the arc tube 10, and an ultraviolet-ray shielding globe 50, which is fixed to the front side of the base 20 and surrounds the arc tube 10 and the lead support 03.

The arc tube 10 includes pinch seal portions **13*a* and 13*b*, each rectangular in cross section, formed at opposing end portions of an enclosed glass sphere 12 having an elliptical shape defining an electric discharge space, and in which cylindrical elongated portions 14*a* and 14*b* which are not pinch-sealed are formed integrally. For starting, a rare gas, mercury, and a metal haloid are sealed in the glass sphere 12. Discharge electrodes 15*a* and 15*b* formed of tungsten are provided in opposition to each other within the discharge space of the enclosed glass sphere 12, and the discharge electrodes 15*a* and 15*b* are connected to molybdenum foils 16*a* and 16*b* sealed in the pinch seal portions 13*a* and 13*b*. Lead wires 18*a* and 18*b* respectively connected to the molybdenum foils 16*a* and 16*b* are led out to the outside from the pinch seal portions 13***a* and 13*b* through the elongated portions 14*a* and 14*b*. The elongated portion 14*a* on the front end side is held by a metal band 32 spot-welded to the lead support 30, while the lead wire 18*a* is spot-welded to the metal band 32. The lead support 30 is plasma-welded to a connector terminal 23 provided on the back of the base 20. On the other hand, the elongated portion 14*b* on the rear end side is engaged with the engagement concave portion 21 formed on the front side of the base 20, and the lead wire 18*b* is plasma-welded to a connector terminal 24 fixed on the back of the insulating base 20 by insertion molding. Thus, the arc tube 10 has a structure wherein its front end portion supported by the single metal lead support 30 projects over and in front of the insulating base 20, and its rear end portion is supported by the engagement concave portion 21 formed on the front side of the base 20.

The insulating base 20 is formed, for example, of synthetic resin such as PPS or the like, and a pair of connector terminals 23 and 24 are provided in a cylindrical wall 22 formed on its back to thereby form a connector. A partition 22*a* lying across the cylindrical wall 22 is formed between the connector terminals 23 and 24 so that good insulation between the terminals 23 and 24 is ensured. High voltage leads $C_1$ and $C_2$ extending from a lighting circuit (not shown) are connected to the connector terminals 23 and 24. A connector cover 25 is made integral with the connector cylindrical wall 22 by ultrasonic wave welding so that these members cannot be separated from each other.

The lead support 30, which extends in front of the insulating base 20, is covered with an insulating cylinder 34 formed of ceramic so that an electric discharge cannot be produced between respective electric passageways on the sides of connector terminals 23 and 24. The lead support is inserted into the insulating cylinder 34 in advance, and the lead support 30 and the insulating cylinder 34 are fixed integrally by non-organic bonding material or push-on fixing. The insulating cylinder 34 integral with the lead support 30 is made integral with the insulating base 20 by insertion molding so that the rear end portion of the cylinder 34 penetrates to the back of the base 20 and the lead support 20 also penetrates the cylinder 34. On the front side of the base 20, a ceramic disc 40 for fixing and supporting the ultraviolet-ray shielding globe 5 is fixed to the base 20 by insertion molding. That is, the ceramic disc 40 has a conical trapezoidal shape so as to prevent detachment if the back circumferential edge is inserted to and formed in the base 20. Holes 42 and 44 are formed in the ceramic disc 40, and the arc tube 10 and the insulating cylinder 34 penetrate forward of the holes 42 and 44. Reference numeral 36 designates a ceramic pipe covering the rear-side lead wire 18*b* to thereby ensure insulation between the lead wire 18*b* and the lead support 30.

The ultraviolet-ray shielding globe 50 has a configuration in which the surface of a cylindrical glass globe body (coning code no. 7,740) enclosed at its top is coated with a ZnO film 52, which has the function of cutting off ultraviolet rays in a predetermined wavelength range, and the ZnO film 52 is further covered with a SiC film 54 which has the function of cutting off ultraviolet rays in a predetermined wavelength range, although the cut-off ratio is smaller than that of the ZnO film 52. The opening-side base end portion of the globe 50 is bonded and fixed to an annular groove 46 formed in the ceramic disc 40 by a non-organic bonding material so as to surround the lead support 30 and the arc tube 10.

Figure 3:
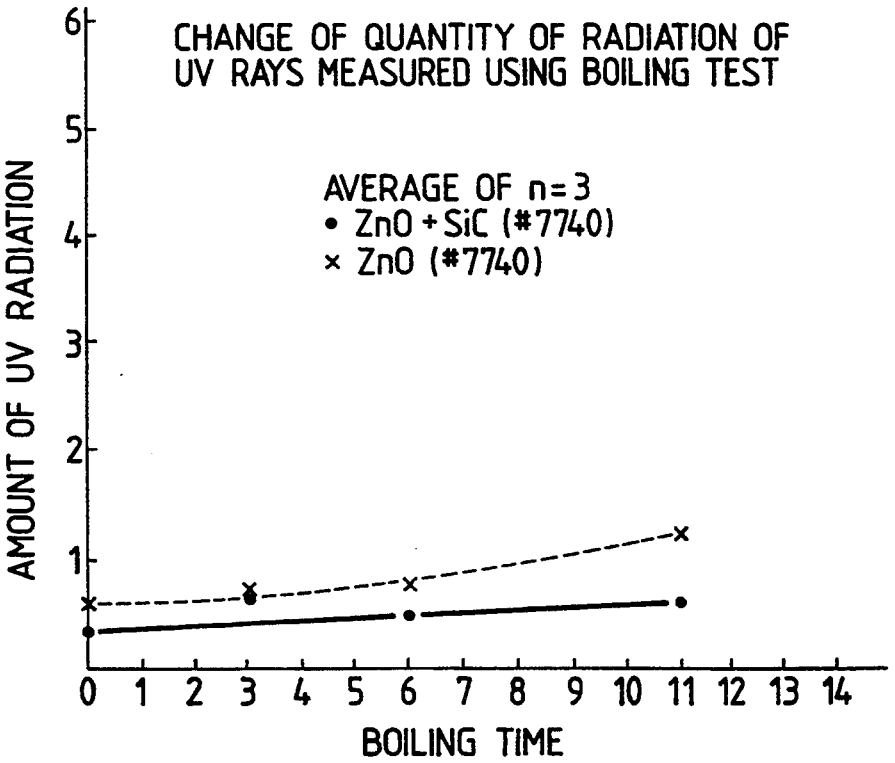
FIG. 3 is a diagram showing the change of quantity of radiation of ultraviolet rays measured using boiling tests performed on an ultraviolet-ray shielding globe.
Figure 4:
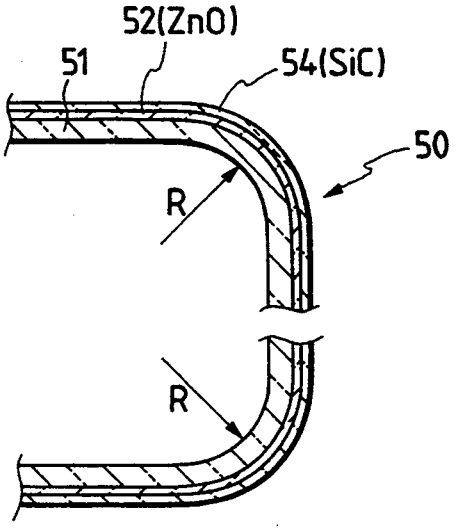
FIG. 4 is a partially expanded section of the ultraviolet-ray shielding globe.
Figure 5:
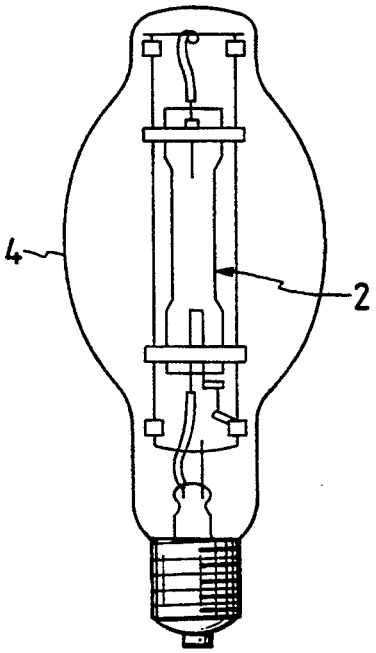
FIG. 5 PRIOR ART
FIG. 5 is a sectional view of a conventional electric discharge lamp.

FIG. 3 is a diagram showing the change of quantity of radiation of ultraviolet rays measured using boiling tests performed on an ultraviolet-ray shielding globe constructed according to this embodiment. As is apparent from this diagram, the quantity of radiation of ultraviolet rays is smaller in the case of forming a SiC film on a ZnO film than in the case of forming only a ZnO film. That is, it is possible to obtain a large effect of cutting ultraviolet rays by forming a SiC film on the ZnO film.

Preferably, the thickness of the ZnO film 52 formed on the surface of the globe body 51 is in a range of 0.5 to 2.0 μm. That is, the effect of cutting ultraviolet rays is deteriorated if the thickness is not thicker than 0.5 μm, while on the other hand the ZnO film is apt to be separated due to thermal stress if the thickness is greater than 2.0 μm. Accordingly the range of 0.5 to 2.0 μm is preferable.

The SiC film 54 applied over the ZnO film 52 is not eroded due to exposure to water, and the SiC film 54 is intimately bonded with the ZnO film to prevent separation from the latter. There is, however, a danger that the SiC film 54 could be eroded by water if it is too thin, and it is therefore necessary to make the thickness of the SiC greater than 0.3 μm. On the other hand, there is a danger that the SiC film 54 might separate due to thermal stress in the same manner as in the case of the ZnO film 52 if its thickness is greater than 0.8 μm, and there is also a danger of separation due to decomposition by solvents (organic material). Accordingly, the range from 0.3 to 0.8 μm is preferable.

Further, to prevent the ZnO film 52 or the SiC film 54 from separating due to thermal stress, it has been confirmed by experiments that the radius of curvature R of the top corner portion of the ultraviolet-ray shielding globe should be greater than 5 mm. Further, since the refractive index of the SiC film is smaller than that of the ZnO film, and the SiC film is more transparent and thinner than the ZnO film, the reflective loss is small and the transmission factor of visible light is therefore improved.

Reference numeral 26 represents an annular focusing ring provided at the circumferential edge portion of the base 20. A frontward/rearward positioning protrusion 26*a* forming a reference portion for positioning a bulb in the frontward/rearward direction (i.e., a direction parallel to the optical axis of the reflector) contacts the circumferential edge portion of a bulb insertion hole (not shown) of a reflector on the front side of the focusing ring 26. A notch 26*b*, which engages an engagement convex portion on the bulb insertion hole side of the reflector for performing circumferential positioning of the bulb, is formed in a portion of the outer circumferential edge of the focusing ring 26. The focusing ring 26 and the base 20 abut each other through a metal ring 27, with the abutting surfaces of the rings 26 and 20 integrally welded to the metal ring 27 by high frequency induction heating. To this end, the rear-end side lead wire 18*b* is welded to the connector terminal 27, the front-end side lead wire 18*b* is welded to the metal band 32, and then the metal band 32 is welded to the lead support 30 to thereby fix the arc tube 10 to the base 20. Thereafter, with the arc tube 10 lit, the focusing ring 26 is moved and adjusted axially and circumferentially to make the positional relation of the focusing ring 26 with respect to the electrodes 15*a* and 15*b* proper, whereupon the focusing ring 26 is welded and fixed to the base 20 by high frequency induction heating. (This adjustment is called aligning).

As is apparent from the above description, according to the electric discharge lamp apparatus forming a light source of an automotive lighting instrument according to the present invention, ultraviolet rays in wavelength ranges harmful to health or damaging to adjacent components are cut off since light emitted from the arc tube is transmitted through the ultraviolet-ray shielding globe. Accordingly, the safety and durability of the lighting instrument are ensured.

Further, since the ZnO film formed on the surface of the ultraviolet-ray shielding globe is covered with a SiC layer, which is not subject to erosion by water, the ZnO film can never directly contact water droplets adhering to the ultraviolet-ray shielding globe. Accordingly, problems such as the ZnO film being eroded by water and thus peeling or the ZnO film becoming dull due to contact with water are eliminated. Therefore, the safety and durability of the lighting instrument are ensured, and a stable quantity of light can be produced for a long time.

What is claimed is:

1. In an electric discharge lamp apparatus for use as a light source of an automotive lighting instrument in which an arc tube forming a light source body and mounted on an insulating base is at least partially surrounded by an ultraviolet-ray shielding globe in which a ZnO film is formed on the surface of a glass body of said globe, the improvement wherein an SiC film is formed on said ZnO film.

2. The electric discharge lamp apparatus according to claim 1, wherein said glass body is composed of glass which cuts off ultraviolet rays in a wavelength range shorter than 320 nm, and said ZnO film cuts off ultraviolet rays in a range of 320 to 380 nm.

3. The electric discharge lamp apparatus according to claim 1, wherein said SiC film is thinner than said ZnO film.

4. The electric discharge lamp apparatus according to claim 1, wherein the thickness of said ZnO film is in a range of 0.5 to 2.0 $\mu$m.

5. The electric discharge lamp apparatus according to claim 1, wherein the thickness of said SiC film is in a range of 0.3 to 0.8 $\mu$m.

6. The electric discharge lamp apparatus according to claim 1, wherein the radius of curvature of a top corner portion of said globe is greater than 5 mm.

* * * * *